US010319516B2

(12) United States Patent
Sumitomo et al.

(10) Patent No.: US 10,319,516 B2
(45) Date of Patent: Jun. 11, 2019

(54) IGNITION COIL

(71) Applicant: Mitsubishi Electric Corporation, Tokyo (JP)

(72) Inventors: Yuma Sumitomo, Tokyo (JP); Mitsuhara Hashiba, Tokyo (JP); Nobuyuki Sawazaki, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/549,189

(22) PCT Filed: May 13, 2015

(86) PCT No.: PCT/JP2015/063722

§ 371 (c)(1),
(2) Date: Aug. 7, 2017

(87) PCT Pub. No.: WO2016/181518

PCT Pub. Date: Nov. 17, 2016

(65) Prior Publication Data

US 2018/0096786 A1 Apr. 5, 2018

(51) Int. Cl.

| | |
|---|---|
| ***H01F 38/00*** | (2006.01) |
| ***H01F 38/12*** | (2006.01) |
| ***H01F 1/053*** | (2006.01) |

(52) U.S. Cl.

CPC ..... *H01F 38/12* (2013.01); *H01F 1/053* (2013.01); *H01F 2038/127* (2013.01)

(58) Field of Classification Search

CPC ..... H01F 1/053; H01F 38/12; H01F 2038/127
See application file for complete search history.

(56) References Cited

U.S. PATENT DOCUMENTS 4,480,377 A * 11/1984 House ..... H01F 3/14 29/593
4,990,881 A * 2/1991 Ooyabu ..... H01F 3/14 123/634

(Continued)

FOREIGN PATENT DOCUMENTS

JP 10-275732 A 10/1998
JP 10-294228 A 11/1998

(Continued)

OTHER PUBLICATIONS

Communication dated Apr. 3, 2018, issued by the Japanese Patent Office in counterpart Japanese Application No. 2017-517534.

(Continued)

*Primary Examiner* — Hieu T Vo
*Assistant Examiner* — Sherman D Manley
(74) *Attorney, Agent, or Firm* — Sughrue Mion, PLLC; Richard C. Turner

(57) ABSTRACT

A magnetic path is formed of a center core disposed inside a first coil and second coil, a first side core and second side core disposed outside the first coil and second coil and coming into contact with the center core, and a magnet disposed between the first side core and second side core, wherein a shape of a space formed by a portion of contact between the first side core and second side core is a shape that forms an insertion portion of the magnet disposed obliquely with respect to the magnetic path, and voids perpendicular with respect to the magnetic path at either end portion of the magnet.

4 Claims, 6 Drawing Sheets

(56) References Cited

U.S. PATENT DOCUMENTS 5,927,259 A * 7/1999 Ando ..... F02P 3/02 123/634
6,860,256 B2 * 3/2005 Nakamura ..... F02P 3/02 123/621
7,796,004 B2 * 9/2010 Matsubayashi ..... H01F 38/12 123/634
2004/0069288 A1 * 4/2004 Shimada ..... F02P 3/02 123/635
2004/0217841 A1 * 11/2004 Nuebel ..... H01F 27/24 336/220
2005/0134417 A1 * 6/2005 Maekawa ..... H01F 38/12 336/92
2006/0226945 A1 * 10/2006 Maekawa ..... H01F 38/12 336/90
2008/0266040 A1 * 10/2008 Matsubayashi ..... H01F 27/022 336/96
2009/0194084 A1 * 8/2009 Kojima ..... H01F 38/12 123/634
2011/0239999 A1 * 10/2011 Steinberger ..... H01F 38/12 123/634
2014/0080077 A1 * 3/2014 Frontczak ..... H01T 13/44 431/258
2018/0025835 A1 * 1/2018 Idogawa ..... H01F 38/12

FOREIGN PATENT DOCUMENTS

JP 2007-103482 A 4/2007
JP 2008-277461 A 11/2008
JP 2009-076734 A 4/2009

OTHER PUBLICATIONS

International Search Report for PCT/JP2015/063722 dated Jun. 23, 2015 [PCT/ISA/210].
Communication dated Aug. 16, 2018 issued in corresponding Chinese Application No. 201580079944.5.

* cited by examiner $l_{g1} > t$

IGNITION COIL

CROSS REFERENCE TO RELATED APPLICATIONS

This application is a National Stage of International Application No. PCT/JP2015/063722, filed on May 13, 2015, the contents of all of which are incorporated herein by reference in their entirety.

BACKGROUND OF THE INVENTION

Field of the Invention

The present invention relates to an ignition coil, and in particular, relates to an ignition coil that supplies a high voltage to an ignition plug of an internal combustion engine.

Description of the Related Art

A magnetic circuit of a closed magnetic path configuration used in an existing internal combustion engine ignition coil is configured of a center core disposed inside a first coil and second coil, and a side core of which one end face comes into contact with one end face of the center core and another end face comes into contact with another end face of the center core across a magnet.

Other than this, there is a configuration such that a plate-form magnet with an area greater than a sectional area of the core is attached obliquely with respect to a magnetic path to a side core positioned outside a first coil and second coil, and disposed in a position intersecting on a perpendicular line equidistant from a central portion of a first coil and second coil winding, as disclosed in, for example, JP-A-10-275732 (Patent Document 1). According to the configuration disclosed in Patent Document 1, a position of a void is a position farthest from the first coil and second coil, because of which there is an advantage in that a decrease in binding due to an effect of magnetic flux leaking from the void can be reduced.

Patent Document 1: JP-A-10-275732

However, the internal combustion engine ignition coil disclosed in Patent Document 1 is such that a void is formed at either end of the magnet, and in the same way as the magnet, the void is formed obliquely with respect to the magnetic path. Because of this, magnetic flux leaking from one core end face reaches another core end face on an opposite side via the void, but as the orientation of the void is oblique with respect to the magnetic path, magnetic path length increases, magnetic resistance increases, and a magnetic property deteriorates. When wishing to reduce the magnetic resistance of the void portion, it is sufficient to reduce the magnet thickness, but there is a problem in that strength decreases, assembly becomes difficult, and productivity decreases.

Also, the internal combustion engine ignition coil is such that there is no projection or the like for positioning on a periphery of a void corresponding to a magnet insertion portion, because of which there is also a problem in that positional deviation of the magnet occurs due to an effect of magnetic force caused by magnetic flux generated when assembling a magnetic circuit or when energizing the first coil, and productivity and performance decrease. In order to solve this problem, there is a method whereby the magnet and core are fixed with an adhesive, but equipment for applying the adhesive is necessary, and a cost of a production line increases.

SUMMARY OF THE INVENTION

The invention, in consideration of the heretofore described kinds of problem, has an object of providing an ignition coil such that an increase in magnetic circuit resistance can be restricted, and positional deviation when energizing and de-energizing a first coil is prevented, whereby a decrease in performance and productivity can be restricted.

An ignition coil according to the invention includes a center core disposed inside a first coil and second coil, a first side core and second side core disposed outside the first coil and second coil and coming into contact with the center core, and a magnet disposed between the first side core and second side core, thereby forming a magnetic path passing through the center core, the first side core and second side core, and the magnet, wherein the first side core and second side core form a space at a portion of contact between the two, and a shape of the space is a shape that forms an insertion portion of the magnet disposed obliquely with respect to the magnetic path, and voids perpendicular with respect to the magnetic path at either end portion of the magnet.

According to the ignition coil according to the invention, a magnetic path length of a space can be minimized, because of which magnetic resistance decreases, and a magnetic property improves. Also, as a space face has a role of holding a magnet, magnet positioning can be carried out when assembling, in addition to which positional deviation of the magnet due to magnetic force when energizing a first coil is restricted, and a decrease in coil performance can be prevented.

The foregoing and other objects, features, aspects and advantages of the invention will become more apparent from the following detailed description of the invention when taken in conjunction with the accompanying drawings.

DETAILED DESCRIPTION OF THE PREFERRED EMBODIMENTS

Figure 1:
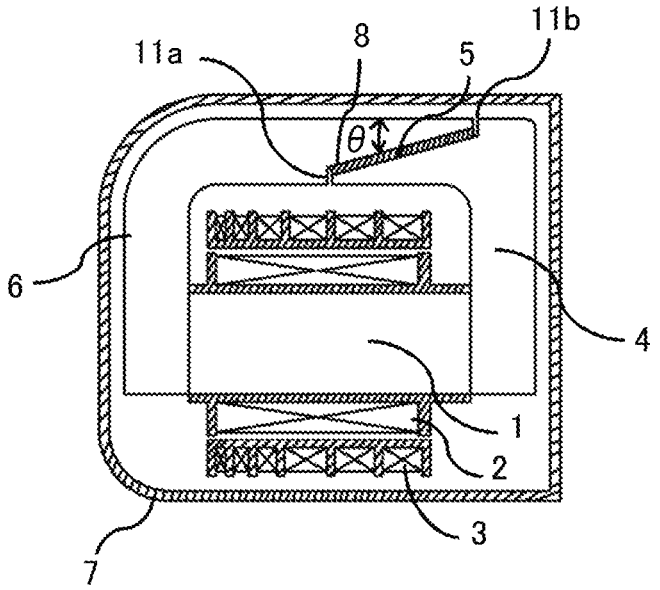
FIG. 1 is a sectional view showing an ignition coil according to a first embodiment of the invention.

Hereafter, referring to the drawings, a description will be given of preferred embodiments of an ignition coil according to the invention. The description will be given with an internal combustion engine ignition coil as an example.

First Embodiment

Figure 2:
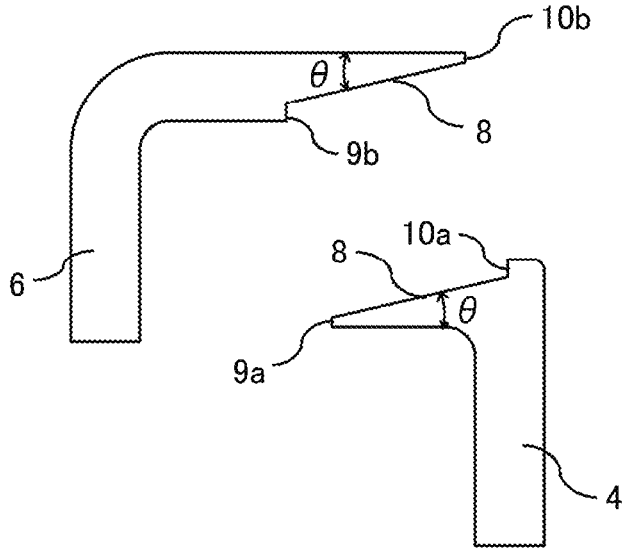
FIG. 2 is a top view showing side cores of FIG. 1.

FIG. 1 is a sectional view showing an internal combustion engine ignition coil according to a first embodiment of the invention, and FIG. 2 is a top view showing side cores of FIG. 1.

As shown in FIG. 1 and FIG. 2, the internal combustion engine ignition coil according to the first embodiment is such that a first coil 2 is provided outside a practically I-shaped center core 1 configured by stacking electromagnetic steel sheets. A second coil 3 is provided outside the first coil 2. One end face of an L-shaped first side core 4 is in contact with one end face of the center core 1. One end face of a magnet 5 is in contact with another end face of the first side core 4. The magnet 5 is magnetized in a direction opposite a direction of magnetic flux generated by an energizing of the first coil 2. One end face of an L-shaped second side core 6 is in contact with another end face of the magnet 5. Another end face of the second side core 6 is in contact with the center core 1, whereby a closed magnetic path configuration is formed by the center core 1, first side core 4, magnet 5, and second side core 6. Further, the internal combustion engine ignition coil configured as heretofore described is housed in a case 7. In the description above, a closed magnetic path passing through the center core 1, first side core 4, magnet 5, and second side core 6 is configured, but a configuration passing through a closed magnetic path such that a magnet other than the magnet 5, or a magnetic body other than the center core 1, first side core 4, and second side core 6, is added to the previously described closed magnetic path may be adopted as necessary.

The first side core 4 and second side core 6 are of an L-shape formed by stacking electromagnetic steel sheets. In order to dispose the magnet 5 obliquely at an angle θ with respect to the magnetic path, the first side core 4 is such that an inner peripheral side of the core is longer in a longitudinal direction than an outer peripheral side, and the second side core 6 is such that an outer peripheral side of the core is longer in a longitudinal direction than an inner peripheral side. An insertion portion (8) of the magnet (5) is of a dimension equal to or greater than a width of the magnet 5. Inner peripheral side end portions 9*a* and 9*b* and outer peripheral side end portions 10*a* and 10*b* of the first side core 4 and second side core 6 are cut off at θ=90°, that is, perpendicular with respect to the magnetic path. Because of this, an angle of 90+θ° is formed in a portion of the outer peripheral side end portion 10*a* of the first side core 4, and an angle of 90+θ° is also formed in a portion of the inner peripheral side end portion 9*b* of the second side core 6. When the first side core 4 and second side core 6 are assembled across the magnet 5, voids 11*a* and 11*b*, which are perpendicular with respect to the magnetic path and are flat, are formed at either end of the magnet 5.

In this way, the internal combustion engine ignition coil according to the first embodiment is such that a magnetic circuit is formed of the center core 1 disposed inside the first coil 2 and second coil 3, the first side core 4 and second side core 6, which are two side cores disposed outside the first coil 2 and second coil 3 and coming into contact with the center core 1, and the magnet 5 disposed between the first side core 4 and second side core 6, and a shape of a space formed between the first side core 4 and second side core 6 is a shape forming the forms an insertion portion (8) of the magnet (5) disposed obliquely with respect to the magnetic path, and the voids 11*a* and 11*b* that are perpendicular with respect to the magnetic path at either end portion of the magnet 5.

Figure 3:
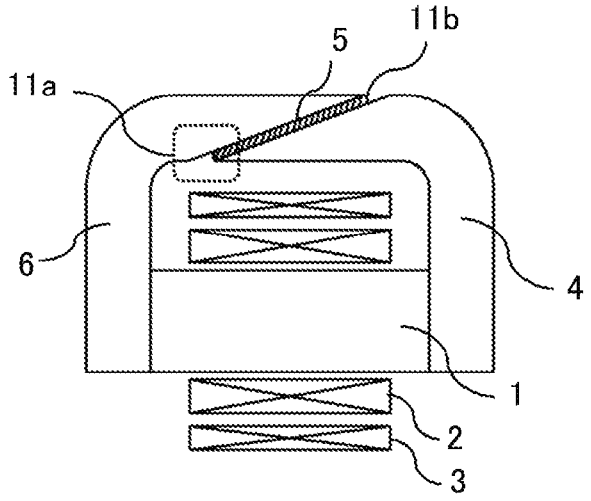
FIG. 3 is a sectional view showing one example of a magnetic circuit of an existing internal combustion engine ignition coil.
Figure 4:
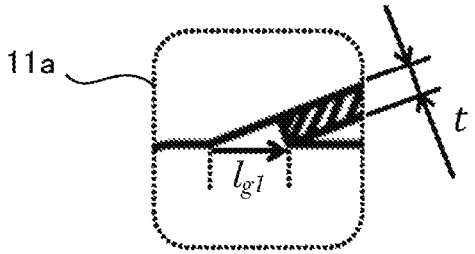
FIG. 4 is a partial enlarged view of FIG. 3.
Figure 5:
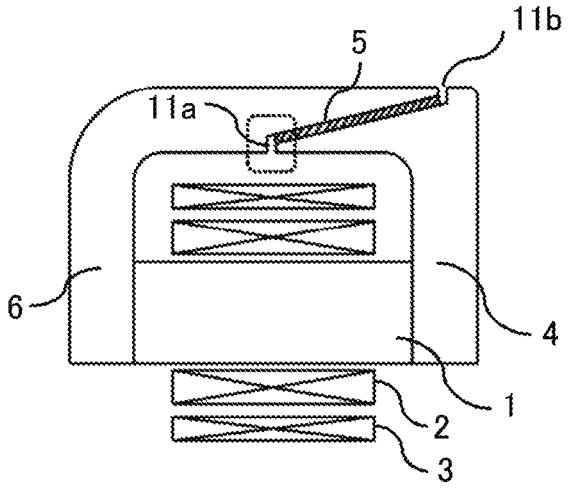
FIG. 5 is a sectional view showing a magnetic circuit of the ignition coil according to the first embodiment of the invention.

As shown in FIG. 3 and in FIG. 4, which is a partial enlarged view of FIG. 3, an existing internal combustion engine ignition coil is such that an orientation of voids formed at either end of the magnet 5 is oblique with respect to a magnetic path length, because of which a magnetic path length lg: of the void is greater than a thickness t of the magnet 5, and magnetic resistance increases. As opposed to this, as shown in FIG. 5 and in FIG. 6, which is a partial enlarged view of FIG. 5, the internal combustion engine ignition coil according to the first embodiment is such that the void direction is parallel to the magnetic path length, because of which a magnetic path length $lg_2$ of the void is the same as the thickness t of the magnet 5, magnetic resistance decreases, and a magnetic property improves.

Furthermore, when assembling, the magnet 5 is adsorbed to the first side core 4 and second side core 6 by magnetic force, but positional deviation occurring when assembling can be restricted by the angles of the outer peripheral side end portion 10*a* of the first side core 4 and the inner peripheral side end portion 9*b* of the second side core 6. Moreover, when magnetic flux generated by the first coil 2 exceeds reverse direction magnetic flux of the magnet 5 when energizing the first coil 2, the magnet 5 attempts to move due to magnetic force, but the movement is kept to a minimum by the angles of the outer peripheral side end portion 10*a* of the first side core 4 and the inner peripheral side end portion 9*b* of the second side core 6, whereby a decrease in performance can be restricted.

Figure 7:
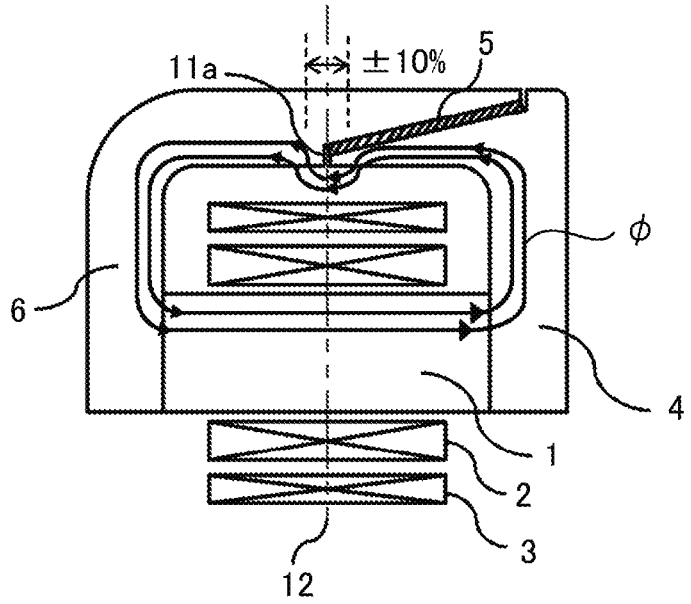
FIG. 7 is a diagram of distribution of magnetic flux in the magnetic circuit shown in FIG. 5.

Also, in the first embodiment, the void 11*a* is configured so as to be positioned on an axial line±10% from a central axis 12 of a winding length of the first coil 2, as shown in FIG. 7.

Figure 8:
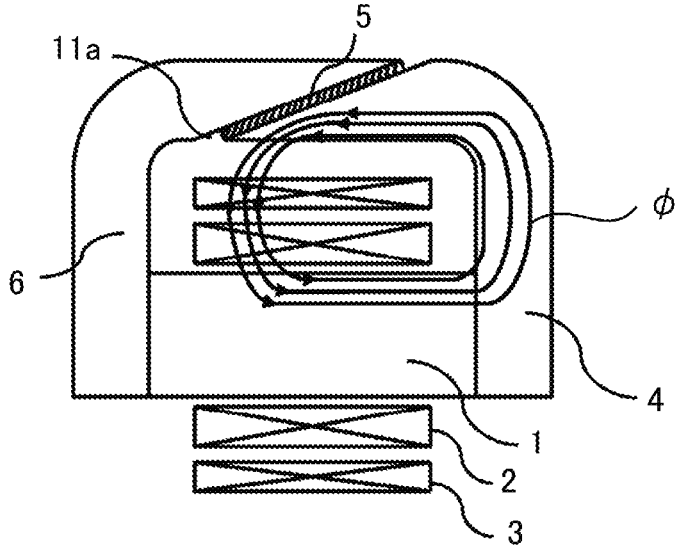
FIG. 8 is a diagram of distribution of magnetic flux in the magnetic circuit shown in FIG. 3.
Figure 9:
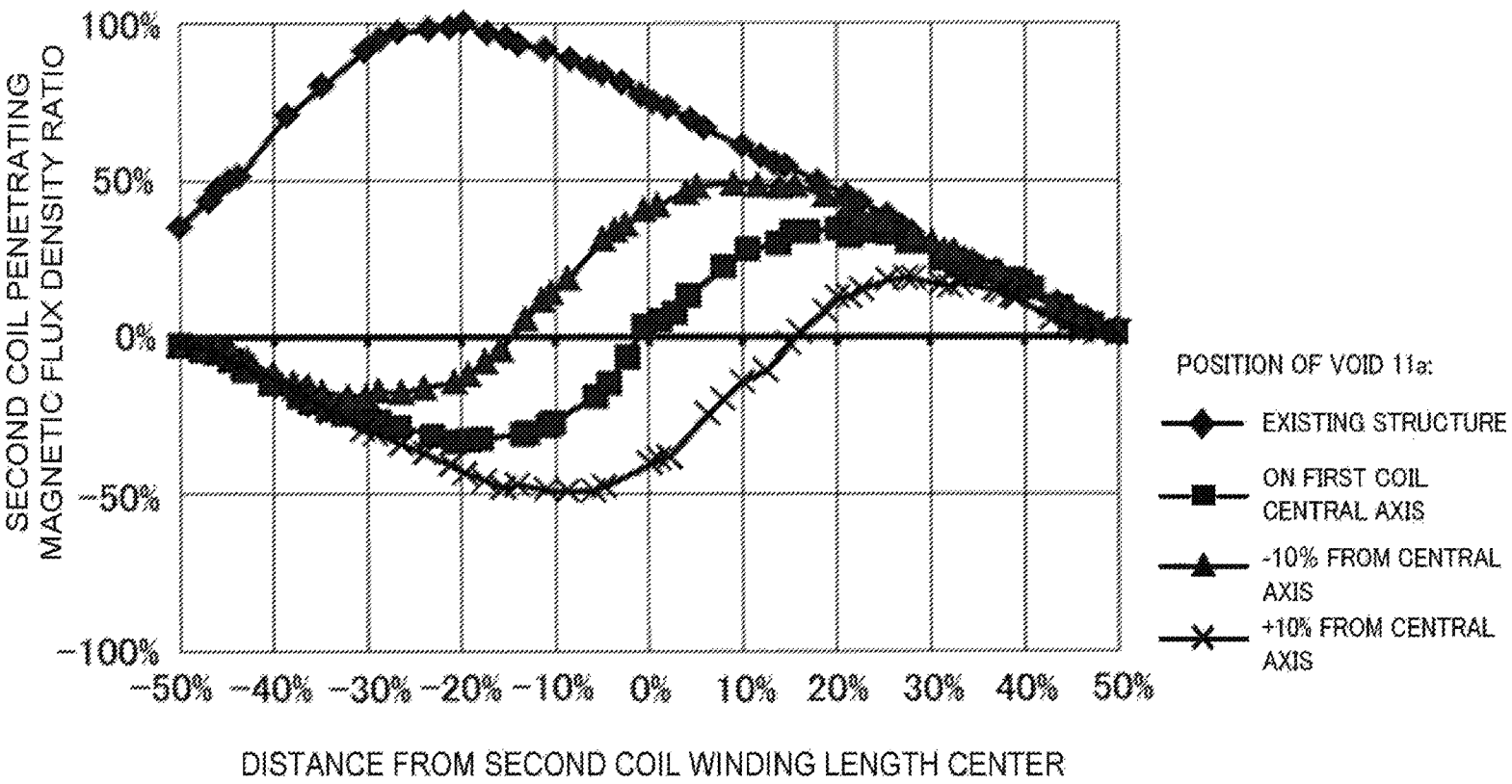
FIG. 9 is a diagram representing a density ratio of magnetic flux penetrating a second coil in a position of a void between an end face of a magnet and a second side core in the ignition coil according to the first embodiment of the invention.

In the magnetic circuit of the existing internal combustion engine ignition coil, the void 11*a* nears contact faces of the center core 1 and second side core 6, because of which magnetic flux distribution is such that magnetic flux ϕ leaking from the first side core 4 avoids the second side core 6 and reaches the center core 1, as shown in FIG. 8. In this case, a number of turns of the second coil 3 with which the magnetic flux ϕ interlinks decreases, and binding properties of the first coil 2 and second coil 3 deteriorate. As opposed to this, the internal combustion engine ignition coil according to the first embodiment is configured so that the position of the void 11*a* is far from contact faces of the center core 1 and the first side core 4 and second side core 6 when seen in terms of magnetic path length, because of which distribution is such that the magnetic flux ϕ reaches the second side core 6 from the first side core 4, as shown in FIG. 7, the number of magnetic fluxes interlinking with the second coil 3 is increased, and binding properties can be improved. FIG. 9 shows density of magnetic flux penetrating the second coil 3 in the position of the void 11*a*. From FIG. 9, it is seen that, when taking a maximum value of penetrating magnetic flux density in the existing configuration to be 100%, magnetic flux density decreases by approximately one-half when the void 11*a* is positioned on an axial line ±10% from the central axis 12, and it is understood that binding properties are improved.

In addition, when an interval $g_1$ of the voids 11*a* and 11*b* is smaller than the thickness t of the magnet 5, magnetic resistance can be reduced, because of which a high-output ignition coil can be realized with a low interruption current.

In the first embodiment, a description has been given of a case in which the magnet 5 and void 11*b* are disposed to the right of the position of the void 11*a*, but the magnet 5 and void 11*b* can be disposed on the opposite side in accordance with fabrication circumstances.

Second Embodiment

Next, an internal combustion engine ignition coil according to a second embodiment of the invention will be described.

Figure 6:
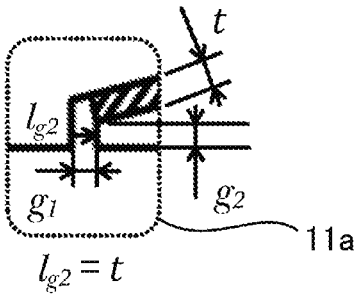
FIG. 6 is a partial enlarged view of FIG. 5.
Figure 10:
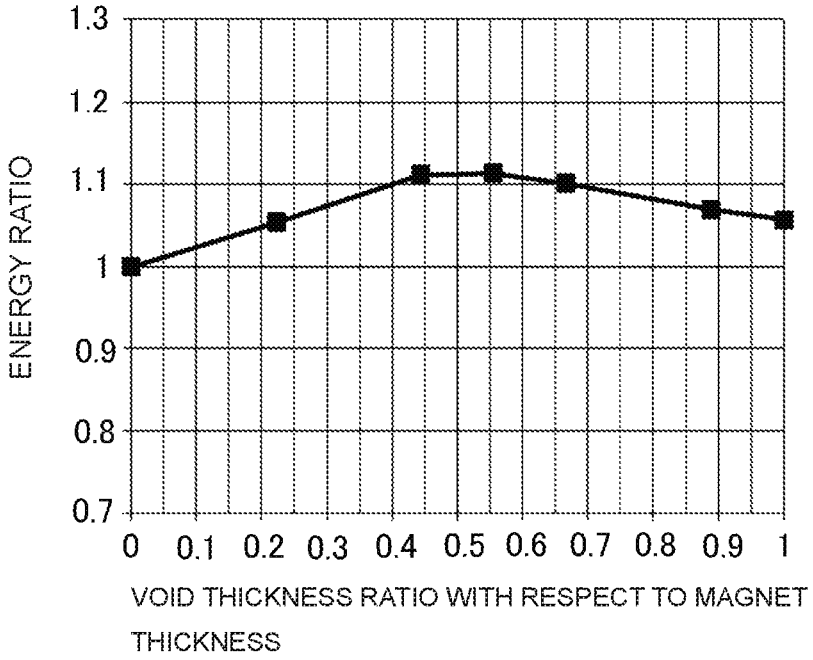
FIG. 10 is a diagram representing energy characteristics of an ignition coil according to a second embodiment of the invention.
Figure 11:
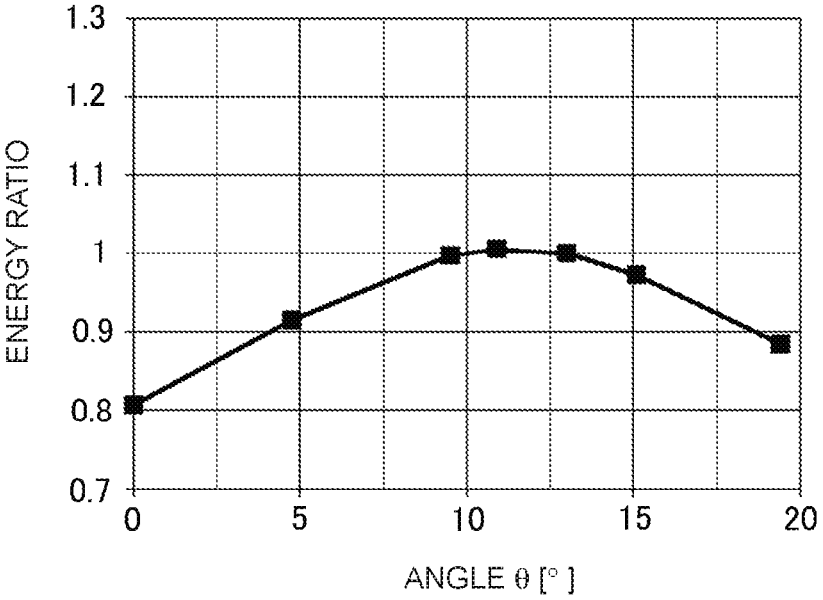
FIG. 11 is a diagram representing energy characteristics of the ignition coil according to the second embodiment of the invention.

FIG. 10 and FIG. 11 are diagrams representing energy characteristics of the internal combustion engine ignition coil according to the second embodiment, and show energy characteristics when the dimensions of the interval $g_1$ and width $g_2$ of the voids 11*a* and 11*b* shown in FIG. 6 are changed. Herein, the void dimensions are adjusted and magnetic resistance reduced so that a high output is obtained with respect to a low interruption current.

The internal combustion engine ignition coil according to the second embodiment is designed so that a primary current flowing into the first coil 2 is 6A, and a number of turns of the first coil 2 is 114T. Output energy is integrally calculated from ampere-turns applied to a primary side and magnetic flux passing through the center core 1. Also, calculation is carried out using magnetic field analysis.

FIG. 10 shows energy characteristics for a ratio with respect to the thickness t of the magnet 5 when the interval $g_1$ is changed from 0 when the width $g_2$ of the voids 11*a* and 11*b* is fixed at the same dimension as the thickness t of the magnet 5. In FIG. 10, it is seen that when energy when the void width is 0 is taken to be 1, energy is highest when the interval g is 0.45 to 0.55 times the thickness t of the magnet 5.

FIG. 11 shows energy characteristics when the width $g_2$ is changed from 0 as far as a width at which the angle $\theta=0$ when the interval $g_1$ of the voids 11*a* and 11*b* is fixed at a ratio of 0.55 times the thickness t of the magnet 5. As the width $g_2$ changes in accordance with the angle $\theta$, FIG. 11 shows energy characteristics with respect to the angle $\theta$. Herein, the angle $\theta$ is such that energy when the angle $\theta=13°$ when the width $g_2$ is of the same dimension as the thickness t of the magnet 5 is taken to be 1. From FIG. 11, it is seen that output energy does not decrease at the width $g_2$ at which $10° \leq \theta \leq 13°$, but output energy decreases in a range other than this.

According to the above, the internal combustion engine ignition coil according to the second embodiment is such that when the interval $g_1$ of the voids 11*a* and 11*b* is 0.45 to 0.55 times the thickness t of the magnet 5, and the width $g_2$ of the voids 11*a* and 11*b* is of a dimension such that $10° \leq \theta \leq 13°$, a coil that has high output at a low interruption current can be realized.

Although the first and second embodiments of the invention have been described, the embodiments can be freely combined, and each embodiment can be modified or abbreviated as appropriate, without departing from the scope of the invention.

What is claimed is:

1. An ignition coil, comprising:

a center core disposed inside a first coil and second coil;

a first side core and second side core disposed outside the first coil and second coil and coming into contact with the center core; and a magnet disposed between the first side core and second side core, thereby forming a magnetic path passing through the center core, the first side core and second side core, and the magnet, wherein the first side core and second side core form a space at a portion of contact between the two, and a shape of the space is a shape that forms an insertion portion of the magnet disposed obliquely with respect to the magnetic path, and voids perpendicular with respect to the magnetic path at either end portion of the magnet, wherein a first end of the first side core comes into contact with a first end surface of the center core portion and a first end of the second side core comes into contact with a second end surface of the center core portion, the second end surface being opposite to the first end surface.

2. The ignition coil according to claim 1, wherein an inner peripheral side void of the voids is on an axial line ±10% from a central axis of a winding length of the first coil.

3. The ignition coil according to claim 1, wherein an interval of the voids is equal to or less than a thickness of the magnet.

4. The ignition coil according to claim 1, wherein an interval of the voids is 0.45 to 0.55 times a thickness of the magnet, and a width of the voids is of a dimension such that an angle $\theta$ with respect to the magnetic path is 10° to 13°.

* * * * *